US005392027A

United States Patent [19]

Brunot et al.

[11] Patent Number: 5,392,027

[45] Date of Patent: Feb. 21, 1995

[54] FULL BRIDGE STRAIN GAGE DEFLECTION SENSOR

[75] Inventors: Frank A. Brunot, Livermore, Calif.; James V. Motsinger, Round Rock; Michael P. Coppo, Austin, both of Tex.

[73] Assignee: DeTek Security Systems, Inc., Vestal, N.Y.

[21] Appl. No.: 787,570

[22] Filed: Nov. 4, 1991

[51] Int. Cl.[6] ..... G08B 13/00

[52] U.S. Cl. ..... 340/561; 73/862.041; 338/2

[58] Field of Search ..... 340/561, 564, 665–666, 340/541, 668, 563; 324/706, 71.1; 73/760, 763, 765, 862.041, 862.044, 862.045, 862.627, 862.628; 338/2, 5, 6; 177/211; 361/397, 400, 402, 409; 364/508

[56] References Cited

U.S. PATENT DOCUMENTS

| | | | |
|---|---|---|---|
| 3,949,822 | 4/1976 | English et al. | 177/211 X |
| 4,200,856 | 4/1980 | Gilcher | 338/2 X |
| 4,385,525 | 5/1983 | Phillips et al. | 73/720 |
| 4,736,194 | 4/1988 | Sticksel | 340/541 |
| 4,804,052 | 2/1989 | Griffen | 177/25.14 |
| 4,817,022 | 3/1989 | Jornod et al. | 73/765 X |
| 4,980,913 | 12/1990 | Skret | 380/23 |
| 5,001,755 | 3/1991 | Skret | 380/46 |
| 5,035,148 | 7/1991 | Okada | 73/862.044 |
| 5,135,062 | 8/1992 | Lockery et al. | 177/211 |

OTHER PUBLICATIONS

Fink, et al., ed., *Electronics Engineers' Handbook*, 2d ed. (McGraw-Hill, 1982) pp. 17–23 through 17–26.

Holman, *Experimental Methods for Engineers*, 3d ed. (McGraw-Hill), pp. 110–113, date unknown.

*PFT ME2* (Micro Engineering II), pp. 16, 18, 20., date unknown.

*The Pressure Strain and Force Handbook*, (Omega), p. E-3, date unknown.

"*VTW-300 Electronic Taut Wire Fence Installation and Maintenace Manual*" (Vindicator Coroporation, Aug. 1989).

*Primary Examiner*—John K. Peng
*Assistant Examiner*—Thomas J. Mullen, Jr.
*Attorney, Agent, or Firm*—Vinson & Elkins

[57] ABSTRACT

A taut wire perimeter fence intrusion detection system is disclosed. The taut wire deflection sensors in the system each include a flexible housing into which is disposed a full resistance bridge having strain gages for each leg. Opposing strain gages in the bridge circuit have predominant directions in common directions. The strain gages are formed directly onto a printed circuit board. An amplifier circuit is also mounted onto the circuit board, for amplifying the differential bridge voltage from the bridge. The taut wire is connected to the housing, for example by way of a slotted bolt and nut, so that horizontal deflection of the taut wire creates strain on the circuit board which is sensed by the strain gage bridge, amplified by the amplifier, and communicated to a data processing system which generates the appropriate alarm condition.

20 Claims, 4 Drawing Sheets

FULL BRIDGE STRAIN GAGE DEFLECTION SENSOR

This invention is in the field of intrusion detection, and is more specifically directed to taut wire deflection sensors.

BACKGROUND OF THE INVENTION

Relatively large areas, such as multiple building campuses, airports and the like, are conventionally secured against undesired entry by way of fencing or other barriers around the perimeter of the secured area. Particularly where portions of the area are not subject to constant human surveillance, either directly by watchpersons or indirectly by camera, remote detection of intrusion or other breach of the perimeter allows deployment of the necessary security personnel as needed. In this way, effective asset protection can be efficiently maintained with relatively few security personnel.

An example of a conventional remote intrusion detection system is the VTW-300 electronic taut wire fence manufactured and sold by Vindicator Corporation. In this system, multiple taut wires make up a perimeter fence. Sensors are connected to the taut wires to sense their deflection, such as may result from an intruder climbing the fence, and to generate an electrical signal to a data processing system for communication of the appropriate alarm or alert condition to security personnel. The security personnel can then initiate the appropriate response to the detected condition.

In this prior system, a strain gage sensor consisting of a single resistive element is used to convert the mechanical motion of the taut wire deflection into an electrical signal. Referring now to FIGS. 1*a* through 1*c*, an example of a conventional sensor, namely the model STW-30 taut wire deflection sensor manufactured and sold by Vindicator Corporation, will now be described. This sensor includes a rubber cylindrical housing 2 having slotted bolt 4 mounted therewithin and extending therefrom; the taut wire is secured within slot 5 by a nut (not shown). Housing 2 includes a rectangular cavity 7 into which strain gage assembly 6 is disposed in a cantilever fashion. Sealant 11 secures strain gage assembly 6 within cavity 7; adhesive seal 17 and sealant 11 together protect assembly 6 from moisture and other environmental effects. Housing 2 is mounted to plate 9, which can be mounted by way of bolts or screws to a fence post, wall, or to a sensor post which in turn is mounted to a fence post or wall.

In this prior sensor, referring in particular to the cross-sectional view of FIG. 1*a*, strain gage assembly 6 is implemented in the conventional manner to measure the strain of a metal member. In the sensor of FIG. 1*a*, this metal member is metal substrate 15, formed of an alloy such as beryllium-copper, and which is relatively thin so that it can flex in a direction normal to its plane. Resistive element 14 is formed of conventional strain gage material such as an alloy of copper-nickel, nickel-chromium, platinum-tungsten, or platinum-iridium, formed in a serpentine pattern so that its length is significantly greater than its width, and arranged so that flexing in a direction normal to its plane will modulate its DC resistance. Resistive element 14 is applied onto insulating film 13, for example "KAPTON" polymer tape, which in turn adheres to metal substrate 15; insulating film 13 thus electrically insulates resistive element 14 from metal substrate 15. Wires 16 are connected to resistive element 14 and extend from assembly 6 out of sealant 11 and seal 17. As illustrated in FIGS. 1*a* and 1*c*, groove 10 encircles housing 2 at a position matching the position of resistive element 14. As such, groove 10 focuses any bending motion of housing 2 resulting from tension on a taut wire connected to slotted bolt 4 to the location of resistive element 14 in strain gage assembly 6, increasing the sensitivity of the sensor.

As indicated in FIG. 1*a*, resistive element 14 provides a single resistance value. As is well known, flexing of or other strain upon resistive element 14 in a direction normal to its plane will change its resistance value. Electrical circuitry (not shown) can thus determine the strain applied to resistive element 14 by measuring its resistance, for example by measuring a voltage drop thereacross for a known current. In the conventional VTW-300 system noted hereinabove, the resistance of element 14 is measured by conventional analog circuitry within a data processing system coupled to wires 16.

It has been found, however, that the conventional strain gage assembly 6, including single resistive element 14, is subject to temperature instability, as the resistance of resistive element 14 changes with temperature. Such instability can cause false alarms to be issued due to temperature changes; worse yet, tension on the taut wire may not result in an alarm condition if the resistance value has changed, due to temperature, so as to be more tolerant of deflection.

By way of further background, another conventional sensor for detecting taut wire deflection has the taut wire connected to a switch mounted within a deformable plastic, in particular a plastic which deforms slowly responsive to a force so that the switch self-centers. The self-centering action thus compensates for slow drift in the switch position due to temperature and other environmental changes. This configuration, however, generates only a digital (open/closed) output, and provides no way of adjusting its sensitivity or response time.

By way of further background, full bridge foil strain gages are well known in the prior art. Examples of conventional full bridge foil strain gages include the "OMEGA" VY 11 90° full bridge cluster, and the 100 QC-350 foil strain gage available from Micro Engineering 2, a division of JP Tech. These conventional strain gages are readily available on insulating films such as "KAPTON" polymer tape, for application to metal members as described hereinabove.

It is therefore an object of the present invention to provide an intrusion detection sensor, such as one adapted for taut wire deflection sensing, having improved temperature stability.

It is a further object of the present invention to provide such a sensor which provides improved signal/noise ratio communication to the data processing system, and improved immunity to noise.

It is a further object of the present invention to provide a strain gage assembly for such a sensor having improved reliability and reduced manufacturing complexity.

It is a further object of the present invention to provide such an assembly which provides flexibility in its sensitivity and response characteristics.

It is a further object of the present invention to provide such an assembly which is capable of determining the direction of deflection so that, when used in an intrusion detection system, the location of the intruder may be determined.

Other objects and advantages of the present invention will be apparent to those of ordinary skill in the art having reference to the following specification together with the drawings.

SUMMARY OF THE INVENTION

The invention may be incorporated into a deflection sensor by way of a full resistance bridge used as the strain gage element. Any change in resistance due to temperature changes affect all legs equivalently, resulting in no differential voltage shift, and thus improving the temperature stability of the deflection sensor. An amplifier circuit is mounted to the board in the sensor, for amplifying the differential output of the resistance bridge and thus improving the signal-to-noise ratio and noise immunity of the deflection sensor. According to a preferred embodiment of the invention, all four legs of the resistance are patterned directly onto a printed circuit board, rather than onto a film applied to the board, thus providing improved reliability and coupling of the deflection strain to the resistance bridge.

DETAILED DESCRIPTION OF THE PREFERRED EMBODIMENT

Figure 2:
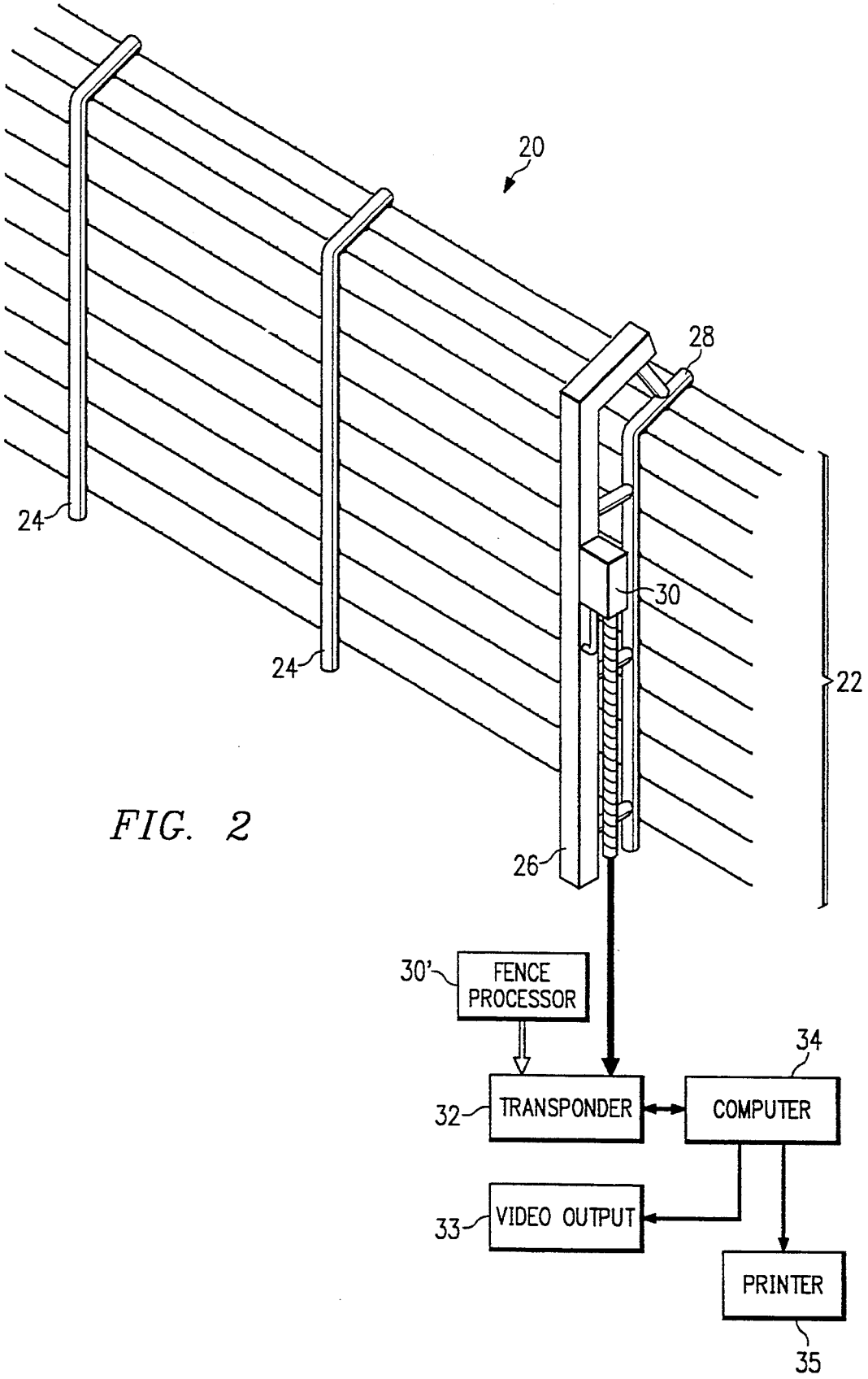
FIG. 2 is a combination perspective view and electrical diagram, in block form, of a portion of a perimeter fence security system incorporating the preferred embodiment of the invention.

Referring now to FIG. 2, a portion of a perimeter fence system 20 into which the present invention may be used will now be described in detail. System 20 includes a number of taut wires 22 which horizontally extend along the perimeter of the area to be secured thereby. It should also be noted that vertical taut wire perimeter fence systems may also utilize the invention. Taut wires 22 may be constructed as double-braided (with reverse twist) galvanized wires having a breaking strength of on the order of 950 lbs, and may or may not have external barbs thereon. Intermediate posts 24 support taut wires 22 along their length, as does sensor post 28 which is attached to sensor support post 26. Sensor posts 26, 28 are periodically deployed along the length of the perimeter fence, and include deflection sensors 40 (not shown in FIG. 2) according to the preferred embodiment of the invention described hereinbelow. In addition, in this example, each of posts 24, 26, 28 may each include an outrigger top portion at an angle on the order of 45° from the vertical, facing the exterior of the secured area. In this example, fence system 20 is intended to detect intrusion from outside the secured area to within (rather than vice versa, as in the case of a prison), and accordingly sensor post 28 is mounted outside of sensor support post 26. Of course, the present invention is also applicable to interior-to-exterior intrusion detection, and also to other perimeter systems such as wall-mounted sensor posts, double outrigger systems, and the like.

Sensor post 28, as noted hereinabove, includes taut wire deflection sensors 40 (not shown in FIG. 2) connected to multiple ones of taut wires 22, as will be described hereinbelow. Each of the deflection sensors are electrically connected to fence processor 30, which in this example is mounted to sensor support post 26. Fence processor 30 according to this example, as in the case of the VTW-300 system noted hereinabove, includes microprocessor-based circuitry for performing such functions as monitoring the status of the taut wire sensors, generating and communicating alarm conditions, calibration of the sensor output due to environmental changes and the like, similarly as the model FP-300 fence processor manufactured and sold by Vindicator Corporation, as described in "VTW-300 Electronic Taut Wire Fence Installation and Maintenance Manual" (Vindicator Corporation, 1989) incorporated herein by this reference.

Fence processor 30 is electrically coupled to transponder 32; multiple fence processors 30' in multiple fence systems 20 may be served by a single transponder 32, as shown in FIG. 2. Transponder 32 is in bidirectional communication with remote computer 34 for communicating polling and status signals between computer 34 and fence processors 30. Computer 34 is generally located remotely from fence system 20, generally in a security headquarters or similar site for the area to be secured, providing information from fence system 20 and other security equipment to security personnel via output devices such as video output 33 and printer 35. As described in U.S. Pat. Nos. 4,980,913 and 5,001,755, both assigned to Vindicator Corporation and incorporated herein by this reference, fence system 20 may include multiple transponders 32 in communication (directly or indirectly) with computer 34 and, if desired, among themselves.

It should be noted that the above configuration of fence system 20 is substantially similar as that for the above-noted VTW-300 system manufactured and sold by Vindicator Corporation, as described in the above-noted manual.

Figure 3:
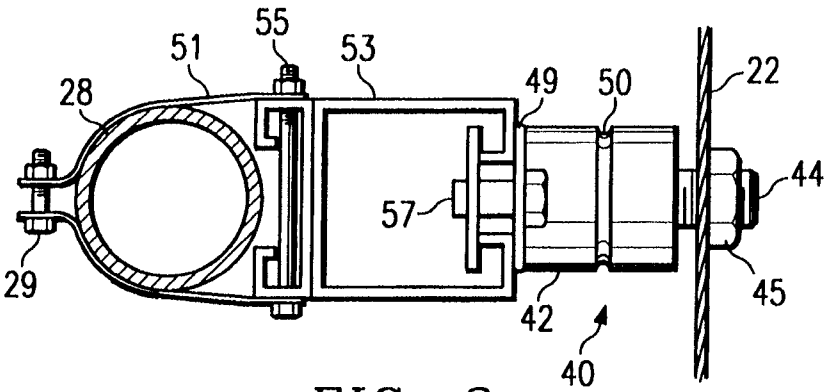
FIG. 3 is a plan view of a taut wire sensor according to the preferred embodiment of the invention, as mounted to a sensor post in the system of FIG. 2.

Referring now to FIG. 3, an example of the mounting of sensor 40 according to this embodiment of the invention to sensor post 28 will now be described. Various other mounting techniques may alternatively be used, depending upon the desired structural result and on the type of sensor post 28 used. Further examples of such mounting for conventional sensors and applicable to sensor 40 are described in the above-noted manual for the VTW-300 system.

Figure 1A:
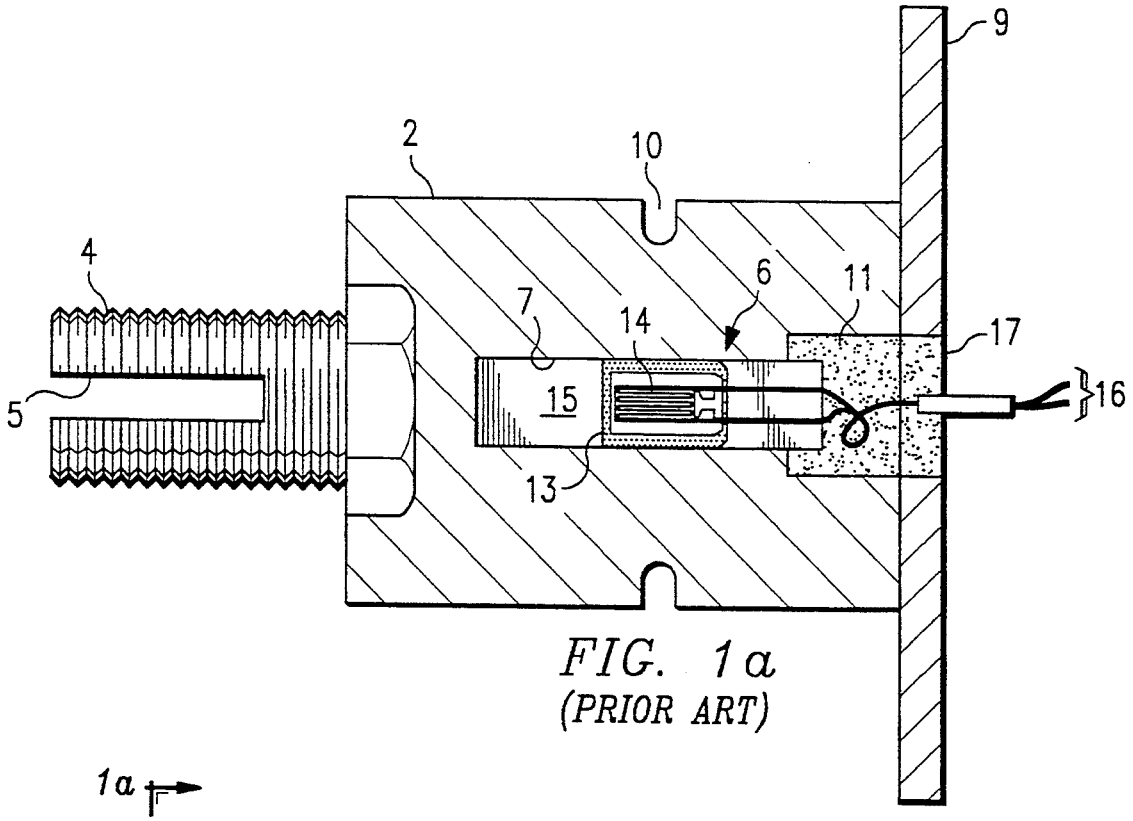
FIG. 1a (PRIOR ART)
FIGS. 1*a* through 1*c* are elevation and cross-sectional views of a taut wire sensor according to the prior art.
Figure 1B:
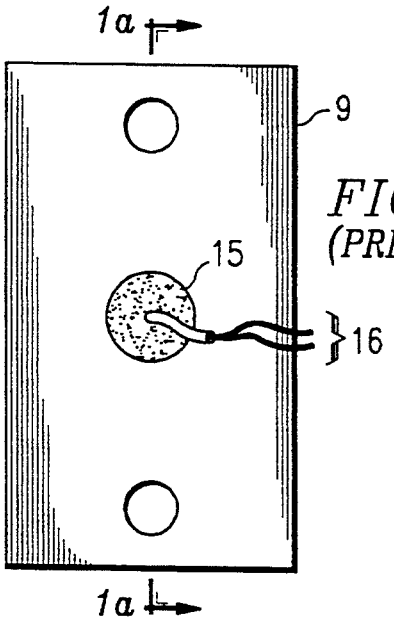
FIG. 1b (PRIOR ART)
Figure 1C:
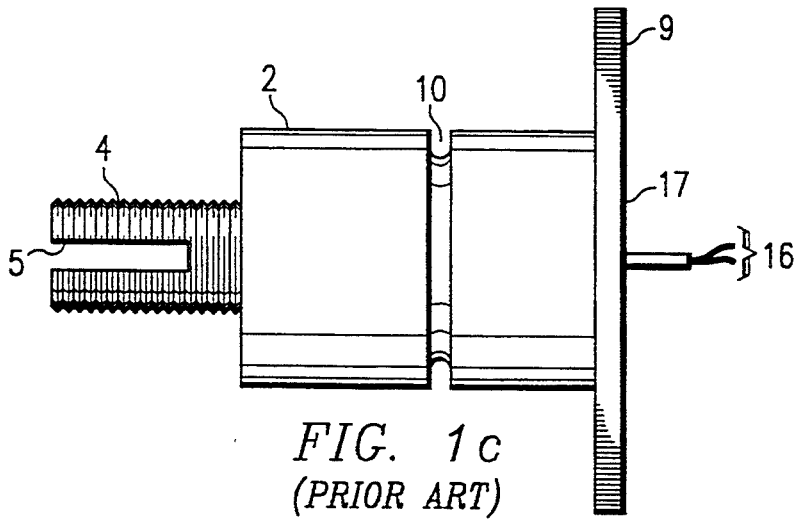
FIG. 1c (PRIOR ART)

Sensor 40 includes housing 42, bolt 44, and plate 49, similarly as in the case of the conventional sensor described hereinabove relative to FIGS. 1*a* through 1*c*. As in the conventional sensor, taut wire 22 fits within a slot in bolt 44, and is secured therewithin by nut 45. Housing 42 of sensor 40 is formed of rubber or other flexible material so that it bends when taut wire 22 is deflected, and fastens to plate 49. Plate 49 in turn secures sensor 40 to box 53 by way of bolt(s) 57. Box 53 is secured to strap 51 by way of bolt(s) 55, with strap 51 wrapping around support post 28 and tightened thereto by bolt 29. Sensor 40 thus fastens taut wire 22 to support post 26, and also senses deflections in taut wire 22 in the manner described hereinbelow.

Sensor 40 is preferably horizontally skewed (i.e., partially rotated about support post 28), for example by an angle of approximately 15°, to preload sensor 40 with a deflection. Such preloading allows detection of the removal of nut 45 and of the cutting of taut wire 22, as housing 42 would return to a non-flexed state in such an event.

Figure 4:
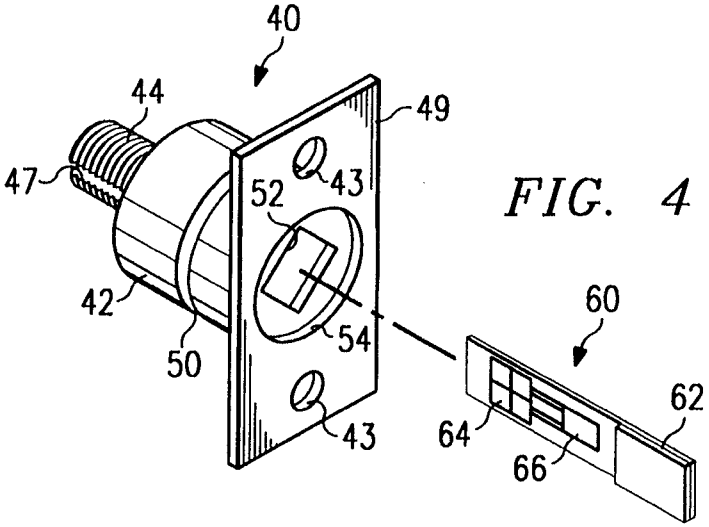
FIG. 4 is a perspective exploded view of a taut wire sensor according to the preferred embodiment of the invention.

Referring now to FIG. 4, a perspective exploded view of sensor 40 according to the preferred embodiment of the invention will now be described. Sensor 40 includes, as noted hereinabove, housing 42 connected to mounting plate 49 and slotted bolt 44 connected thereto for holding one of taut wires 22 (not shown) in slot 47. Mounting holes 43 are provided within plate 49, for mounting sensor 40 to sensor support post 28, as described hereinabove relative to FIG. 3. Rectangular opening 52 in housing 42 receives strain gage assembly 60 in a vertical attitude (in the case where the taut wire deflection will exert a horizontal bending force upon housing 42). Groove 50 encircles housing 42 to focus the bending at a plane in housing 42 which is preferably aligned with the sensing elements in strain gage assembly 60, when inserted into opening 52. Sealing material is preferably introduced around strain gage assembly 60 when in place within housing 42, to environmentally seal strain gage assembly 60 and also to mechanically couple housing 42 thereto.

As illustrated in FIG. 4, strain gage assembly includes full resistance bridge 64, amplifier circuit 66, and connector 62 mounted to printed circuit board 65. The length of board 65 is preferably sufficient that connector 62 will protrude from housing 42 when installed, even after introduction of a sealing material, so that electrical connection thereto is facilitated.

Figure 5:
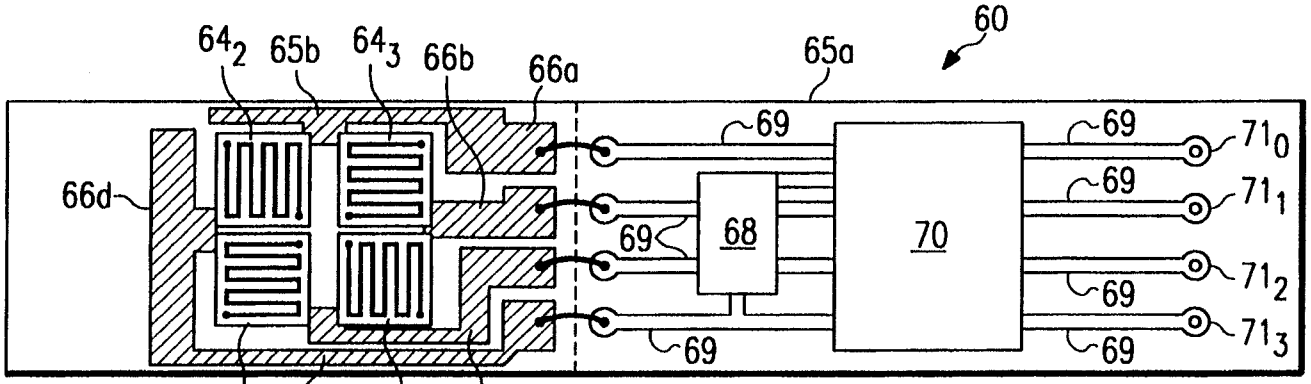
FIG. 5 is an elevation of the strain gage assembly according to the preferred embodiment of the invention.

Referring now to FIG. 5, the physical configuration of strain gage assembly 60 will now be described in further detail. Circuit board 65 is preferably formed of fiberglass or other conventional printed circuit board material, and has two portions 65*a* and 65*b*. Strain gage elements 64 are formed directly onto portion 65*b* and are intended to respond to flexure of board 65, particularly flexure in a direction normal to the plane of board 65. For best sensitivity to such flexure, board should therefore be quite thin, for example on the order of 0.5 mm. Conducting lines 66 extend from nodes of strain gage elements 64, and are connected by wire jumpers to conductors 69 on board portion 65*a*.

Board portion 65 includes amplifier circuit 66, which in this example includes operational amplifier 70 and resistor 68. Plated-through holes 71 are provided on board portion 65, to which connector 62 may be connected, as shown in FIG. 4. By way of example, the dimensions of board 65 are on the order of 1.70 inches by 0.40 inches.

According to this preferred embodiment of the invention, a full bridge strain gage is implemented directly upon board portion 65*b*, by way of four resistive elements $64_0$ through $64_3$. Each of elements 64 is a serpentine conductive pattern, preferably printed directly onto circuit board portion 65*b* by way of a subtractive etching process. An example of such a subtractive process for forming elements 64 is the deposition of metallization to the desired thickness onto circuit board 65, followed by conventional masking of the desired pattern of elements 64 and conducting lines 66 by a chemical resist. The masked board 65 is then exposed to an etching solution to wet etch the metallization from the unmasked locations, leaving elements 64 and conducting lines 66 in the desired locations. Of course, additive processes and other conventional processes for forming printed circuit board wiring to the necessary precision may alternatively be used.

In FIG. 5, each of strain gage elements 64 is illustrated in block form, with a directional axis indicated by the arrow therein. For example, strain gage elements $64_0$ and $64_3$, each having a horizontal arrow, are formed in a serpentine pattern of horizontal legs connected in serpentine fashion by vertical turnarounds at alternating ends; accordingly, the direction of current flow through each of strain gage elements $64_0$ and $64_3$ is predominantly in a horizontal direction. Conversely, strain gage elements $64_1$ and $64_2$ are arranged as vertical elements with horizontal turnarounds on alternating ends, such that the direction of current flow is predominantly in a vertical direction. The interconnection and operation of strain gage elements 64 to detect horizontal bending forces will be described in further detail hereinbelow.

In this example, each of elements 64 preferably has a nominal resistance value on the order of 300 ohms. Construction of strain gage elements 64 according to conventional processes, for obtaining such nominal resistances, is well known to those skilled in the art. The metallization used for strain gage elements 64 is preferably formed of conventional strain gage material, such as an alloy of copper-nickel, nickel-chromium, platinum-tungsten, or platinum-iridium. However, the material of strain gage elements 64 is generally not as conductive as is desirable for electrical interconnection on printed circuit boards. It is therefore preferred to print the metallization patterns in two steps, so that the metal system for conductors 69 on board portion 65*a* can differ from that used to form strain gage elements 64 (and conductors 66, due to their proximity to strain gage elements 64) on board portion 65*b*, with wires or jumpers used to connect respective conductors 66, 69 in the desired manner. Due to the lower conductivity material used for interconnection lines 66 on board portion 65*b*, lines 66 are preferably formed to be as wide as possible and yet fit within the allotted area. Such construction minimizes the series resistance of lines 66 so that as much as possible of the bridge resistance is due to strain gage elements 64, rather than to the series resistance of lines 66.

Board portion 65*a* further includes resistor 68, for implementing a resistance in the circuit having a value selected according to the desired gain, and amplifier 70 for actively amplifying the differential voltage. Terminals 71 connect to connector 62 (not shown in FIG. 5) to electrically connect amplifier circuit 66 and elements 64 with fence processor 30 in system 20, as noted hereinabove.

In-fence system 20, where vertical deflection of taut wire 22 from an intruder climbing the fence is to be detected, the strain of interest for strain gage assembly 60 is in a horizontal direction normal to board 65. This is because the vertical deflection of a horizontal taut wire will exert a horizontal force on slotted bolt 44 and housing 42 of sensor 40, horizontally straining board 65, with the strain detectable by strain gage elements 64 in the manner described hereinbelow.

Figure 6:
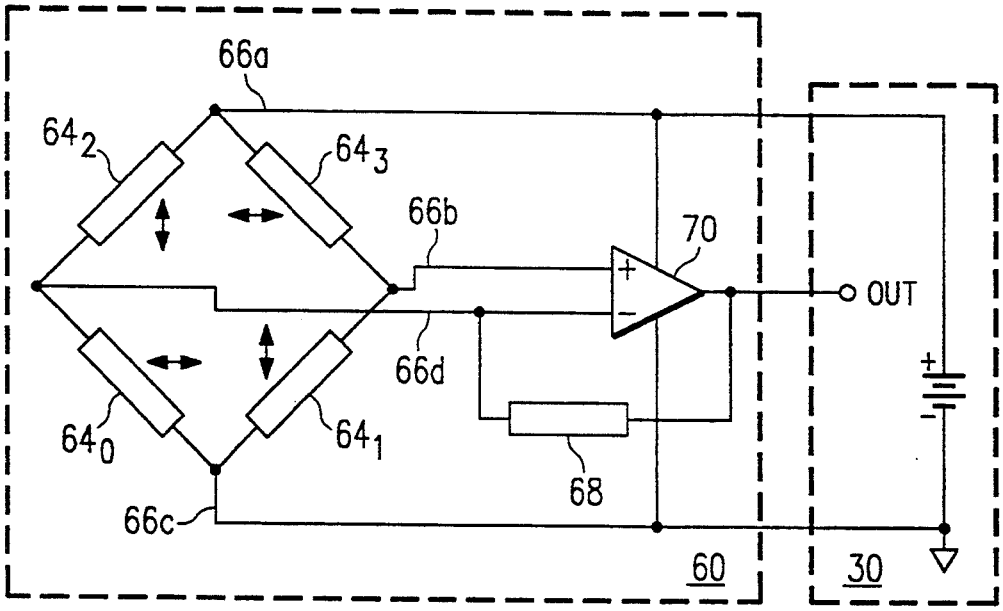
FIG. 6 is an electrical diagram, in schematic form, of the strain gage assembly of FIG. 4.

Referring now to FIG. 6, the electrical circuit of strain gage assembly 60 will now be described in detail. Within strain gage assembly 60, elements 64 are connected to one another in conventional full resistance bridge fashion. Horizontal elements $64_0$ and $64_3$ are connected across from one another, and vertical elements $64_1$ and $64_2$ are also connected across from one another. Conductor line 66a is connected to one end of each of elements $64_2$ and $64_3$ and to DC bias supply 72, either locally or in fence processor 30. Conductor line 66c is connected to one end of each of elements $64_0$ and $64_1$ and to ground. Conductor line 66b is connected to the non-inverting input of differential amplifier 70 and to ends of elements $64_0$ and $64_3$, while conductor line 66c is connected to the inverting input of differential amplifier 70 and to ends of elements $64_0$ and $64_2$. Differential amplifier 70 is of conventional type, for example an LMC6041AIM operational amplifier manufactured and sold by National Semiconductor. Resistor 68 is connected between the output of amplifier 70 and the inverting input to amplifier 70 to control the gain of, and add stability to, amplifier circuit 66 in the conventional manner, having a resistance, for example, on the order of 33 kOhms.

In operation, DC bias supply 72 biases bridge elements 64 and amplifier 70 with a DC bias voltage relative to ground, for example 5 volts. In the conventional manner for full bridge measurements, the differential voltage between lines 66b and 66c in the circuit of FIG. 6 corresponds to the following relationship:

$$\Delta V = V_{bias} * [(R_1/(R_1+R_3)) - (R_0/(R_2+R_0))]$$

where $\Delta V$ is the differential voltage, $V_{bias}$ is the voltage of bias supply 72, and where $R_n$ is the resistance value of an element $64_n$. A null condition, or zero differential DC voltage, exists when the product of the resistances of elements $64_0$ and $64_3$ equals the product of the resistances of elements $64_1$ and $64_2$.

In operation, if board 65 is subjected to a horizontal force so that it bends in the direction toward the side of board 65 on which strain gage elements 64 are formed, strain gage elements 64 will tend to compress, reducing their length in the horizontal direction; conversely, if the horizontal bending force on board 65 is in the direction toward the side of board 65 opposite from that on which strain gage elements 64 are formed, strain gage elements 64 will be elongated. The compression and elongation of strain gage elements 64 will be in the horizontal direction for such a horizontal bending of board 65; the portions of strain gage elements 64 which are vertically oriented will not significantly elongate or compress for such bending. Accordingly, a horizonal bending of housing 42 will affect horizontally oriented strain gage elements $64_0$ and $64_3$ to a much greater extent than to which vertically oriented strain gage elements $64_1$ and $64_2$ will be affected.

As noted hereinabove, however, horizontally oriented strain gage elements $64_0$ and $64_3$ are (electrically) across from one another in the bridge arrangement. A horizontal bending force will thus strongly affect the differential voltage across the bridge. In the case of a horizontal bending deflection in the direction toward the side of board 65 on which elements 64 are formed, such a deflection compressing horizontal legs of strain gage elements 64, the resistance value of each of strain gage elements $64_0$ and $64_3$ will decrease and the resistance of each of strain gage elements $64_1$ and $64_2$ will remain substantially constant. Accordingly, the voltage at the non-inverting input of differential amplifier 70 will rise, and the voltage at the inverting input of differential amplifier 70 will fall, due to the voltage divider action of the bridge of strain gage elements 64. A positive variation in the differential voltage output from amplifier 70 will thus be presented at output OUT.

In the case of a horizontal bending force on housing 42 in the direction away from the side of board 65 on which elements 64 are formed, strain gage elements $64_0$ and $64_3$ will elongate and their resistance value will increase, while the resistance value of strain gage elements $64_1$ and $64_2$ will remain substantially constant. In this case, the voltage at the non-inverting input of amplifier 70 will fall while the voltage at the inverting input of amplifier rises. The output of differential amplifier 70 will thus fall, for a horizontal bending of board 65 in the direction away from the side on which strain gage elements 64 are formed.

Accordingly, the differential voltage applied on lines 66b, 66d to the inputs of amplifier 70 will vary according to the horizontal flexure of board portion 65b, such horizontal flexure due to horizontal deflection of taut wire 22 connected to housing 42. Amplifier 70 will thus amplify this differential voltage and present a signal at its output to fence processor 30 corresponding to the differential voltage at its inputs, and thus corresponding to the degree and direction of flexure of board portion 65a as detected by strain gage elements 64. In particular, the polarity of the differential voltage will indicate on which side of sensor 40 the intruder has deflected taut wire 22, from which the location of the intruder may be deduced.

Figure 7:
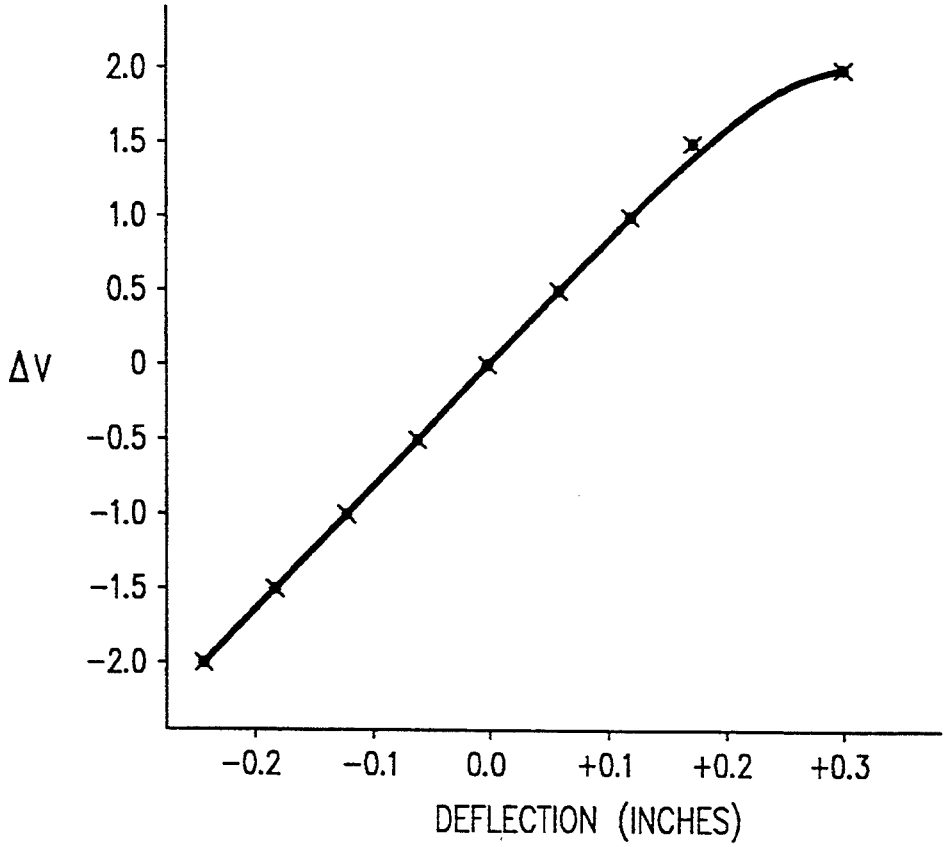
FIG. 7 is a plot of differential voltage output versus deflection for an example of the sensor of FIG. 4.

Referring to FIG. 7, a plot of differential voltage at the output of amplifier 70 versus vertical flexure is shown, for sensor 40 constructed according to the above-described example. In the plot of FIG. 7, horizontal bending of housing 42 in a direction away from the strain gage element 64 side corresponds to negative deflection values, with horizontal bending of housing 42 in a direction toward the strain gage element 64 side of board 65 corresponds to positive deflection values. The deflection is measured from a point on bolt 44 which is approximately two and one-half inches from plate 49, which is approximately at the termination of slot 47 and thus is approximately at the location at which taut wire 22 will be tightened against bolt 44 by nut 45 (see FIGS. 3 and 4). As is evident from FIG. 7, the differential voltage output from amplifier 70 responds in a relatively linear fashion to the amount of deflection, with the differential voltages being on the order of one volt for relatively small deflections (on the order of one-quarter inch). The saturation illustrated in FIG. 7 was found to be due to the operation of amplifier 70, and not to a saturation in the differential voltage generated by the full bridge of strain gage elements 64.

Amplifier 70, as it is located locally within sensor 40, thus provides a strong signal to fence processor 30 as a result of small deflection of housing 42. The magnitude of this signal is significantly improved over prior sensors having one leg of the bridge within the sensor and the remainder of the bridge within the fence processor, or even more remote from the sensor. The signal-to-noise ratio according to the preferred embodiment of the invention is therefore much improved over prior systems. Furthermore, the comparator or other circuitry within fence processor 30 need not be as sensitive as in prior systems, thus allowing for improved noise immunity.

Sensor 40 may also be implemented in fence system 20 so as to detect a break in taut wire 22. As noted above, sensor 40 may be pre-strained in a horizontal direction (with a differential voltage indicated by amplifier 70) so that a break in taut wire 22 would result in housing 42 returning to a "null" position (and a zeroing of the differential voltage). This pre-strain may be implemented by way of a horizontal skew in the mounting of sensor 40, as described hereinabove relative to FIG. 3, for example. The voltage difference between that in the pre-strained position and the null voltage can thus be interrogated, and used in the generation of an alarm condition.

Sensor 40 according to this embodiment of the invention, including a strain gage having a full resistance bridge formed by resistive elements 64, provides significant advantages over prior sensors. Firstly, the stability of sensor 40 is much improved, particularly relative to environmental conditions such as temperature. This stability results from the full bridge configuration of elements 64, particularly with all of the legs in the bridge located in housing 42 of sensor 40, as each of elements 64 are at the same temperature and under the same environmental conditions. Since the differential voltage depends on the ratio of the products of the pairs of resistances of elements 64, modulation of the resistance value in a manner common to all elements 64 will not affect the differential voltage. Furthermore, according to the preferred embodiment of the invention described hereinabove, since each of the four elements 64 is constructed identically (other than the orientation of their sensing axis), with the same metal line width, length and thickness, the temperature coefficient of the resistance of each of elements 64 will be very close to one another.

While the above advantages may be obtained from the present invention when using full bridge strain gages formed onto a film in the conventional manner, additional significant advantages can be obtained by fabricating strain gage assembly 60 directly onto a circuit board, as described hereinabove. The use of conventional strain gages formed onto a film, such as "KAPTON" polymer tape, in the present invention requires the additional manufacturing steps of adhesion to the printed circuit board, and making the necessary interconnection to conductors thereupon. By forming both the strain gage elements and the interconnections for the amplifier circuit by similar etching steps in the manufacture of the printed circuit board, as in the preferred embodiment of the invention, significant manufacturing cost savings may be realized. Further manufacturing economy may be obtained by simultaneously producing multiple sensors in ganged fashion.

Furthermore, the direct patterning of strain gage elements onto the printed circuit board is also believed to provide a strain gage assembly of improved reliability over conventional strain gage assemblies formed on metal substrates.

The deflection sensor according to the present invention, while described hereinabove relative to a taut wire, may also be used to detect the deflection of other types of security barriers. For example, a bar, fence post, or other rigid member may be connected to housing 42 of sensor 40, rather than taut wire 22, with strain gage assembly 60 oriented therewithin in a direction appropriate for the deflection of the member expected in the event of an attempted intrusion. It is contemplated that the benefits of the present invention described hereinabove would also be obtained from use of the present invention in such an environment.

While the invention has been described herein relative to its preferred embodiment, it is of course contemplated that modifications of, and alternatives to, this embodiment, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

We claim:

1. A deflection sensor, comprising:
a flexible housing;
means, connected to one end of said housing, for connecting said housing to a support;
a strain gage, disposed within said housing and comprising:
a circuit board;
first, second, third and fourth strain gage elements disposed on a side of said circuit board and interconnected as a full resistance bridge; and
an amplifier circuit disposed on said circuit board and connected to said bridge, for amplifying a differential voltage from said bridge corresponding to a flexure of said circuit board; and
wherein said first and second strain gage elements have more of their length than that of said third and fourth strain gage elements in a first common direction and are connected in said bridge to oppose one another;
and wherein said third and fourth elements have more of their length than that of said first and second strain gage elements in a second common direction perpendicular to said first common direction and are connected in said bridge to oppose one another; and
means, connected to an opposing end of said housing, for connecting said housing to a taut wire, and wherein said means for connecting said housing to a taut wire comprises:
a threaded bolt extending from said housing and including a slot for receiving said taut wire; and
a nut for engaging said threaded bolt and securing said taut wire thereto.

2. The sensor of claim 1, wherein said first common direction is horizontal.

3. The sensor of claim 2, wherein said circuit board is oriented vertically within said housing, so that the flexure of said circuit board in a first direction results in a differential voltage of a first polarity, and so that the flexure of said circuit board in a second direction results in a differential voltage of a second polarity.

4. The sensor of claim 1, wherein said means for connecting said housing to a support comprises a plate.

5. The sensor of claim 1, wherein said amplifier circuit comprises:
an amplifier, having inputs coupled to said strain gage by way of printed conductor lines on said circuit board, and having an output.

6. The sensor of claim 1, wherein said first, second, third and fourth elements each comprise conductors in a serpentine pattern printed directly onto said circuit board.

7. The sensor of claim 1, wherein said support comprises a sensor post coupled to said housing by said means for connecting said housing to a support.

8. A system for detecting intrusion into an area having a perimeter fence, comprising:
a support post;

a fence member;

a sensor connected to said support post and to said fence member, said sensor comprising:

a flexible housing;

a strain gage disposed within said housing, comprising:

a circuit board;

a first pair of strain gage resistive elements disposed on said circuit board, wherein current flows through each of said first pair of strain gage elements predominantly in a first common direction;

a second pair of strain gage resistive elements disposed on said circuit board, wherein current flows through each of said second pair of strain gage elements predominantly in a second common direction oriented perpendicularly to said first common direction;

wherein said first pair of strain gage resistive elements have more of their length than that of said second pair of strain gage resistive elements in said first common direction and are connected in a full bridge to oppose one another;

and wherein said second pair of strain gage resistive elements have more of their length than that of said first pair of strain gage resistive elements in said second common direction perpendicular to said first common direction and are connected in said full bridge to oppose one another; and an amplifier circuit disposed on said circuit board for receiving a differential voltage from said pairs of strain gage elements corresponding to flexure of said circuit board, amplifying the differential voltage to generate an amplified differential voltage, and presenting the amplified differential voltage at an output; and a data processing system, coupled to the output of said amplifier circuit and receiving the amplified differential voltage, for determining the flexure and determining the direction of the flexure and for indicating an alarm condition responsive to said amplified differential voltage exceeding a limit.

9. The system of claim 8, wherein said first direction is vertical;

and wherein said second direction is horizontal.

10. The system of claim 8, wherein the interconnection of said first and second pairs of elements in said full bridge is such that said first pair of elements oppose one another and said second pair of elements oppose one another.

11. The system of claim 8, wherein said fence member is a taut wire;

wherein said housing is coupled to said taut wire by way of a threaded bolt extending from said housing and including a slot for receiving said taut wire;

and further comprising:

a nut for engaging said threaded bolt and securing said taut wire thereto.

12. The system of claim 8, wherein said amplifier circuit comprises:

an amplifier, having inputs coupled to said strain gage by way of printed conductor lines on said circuit board, and having an output.

13. The system of claim 12, wherein each element in each of said first and second pairs of elements comprise conductors printed directly onto said circuit board in a serpentine pattern.

14. A strain gage assembly, comprising:

a circuit board;

first, second, third and fourth resistance elements, each formed of metallization printed directly onto said circuit board, said first, second, third and fourth resistance elements interconnected with one another to form a bridge circuit;

wherein said first and third resistance elements oppose one another in said bridge circuit and have more of their length than that of said second and fourth resistive elements in a first common direction;

and wherein said second and fourth resistance elements oppose one another in said bridge circuit and have more of their length than that of said first and third resistive elements in a second common direction, such that the flexure of the circuit board in a first direction generates an output of the bridge circuit having a first polarity and flexure of the circuit board in a second direction generates an output of the bridge circuit having a second polarity.

15. The assembly of claim 14, wherein said first and third resistance elements each pass current predominantly in a first direction;

and wherein said second and fourth resistance elements each pass current predominantly in a second direction perpendicular to said first direction.

16. The assembly of claim 15, wherein said first, second, third and fourth resistance elements are arranged in a rectangular pattern on said circuit board.

17. The assembly of claim 14, further comprising:

an amplifier circuit disposed on said circuit board and in contact with said first, second, third and fourth resistance elements.

18. The strain gage assembly of claim 14 and further comprising detection circuitry for detecting the direction of the flexure responsive to a polarity of the output of the bridge circuit.

19. A deflection sensor, comprising:

a flexible housing;

means, connected to one end of said housing, for connecting said housing to a support;

a strain gage, disposed within said housing and comprising:

a circuit board;

first, second, third and fourth strain gage elements disposed on a side of said circuit board and interconnected as a full resistance bridge; and an amplifier circuit disposed on said circuit board and connected to said bridge, for amplifying a differential voltage from said bridge corresponding to a flexure of said circuit board; and wherein said first and second strain gage elements have more of their length than that of said third and fourth strain gage elements in a first common direction and are connected in said bridge to oppose one another, wherein said first common direction is horizontal;

and wherein said third and fourth elements have more of their length than that of said first and second strain gage elements in a second common direction perpendicular to said first common direction and are connected in said bridge to oppose one another;

wherein said circuit board is oriented vertically within said housing, so that the flexure of said circuit board in a first direction results in a differential voltage of a first polarity, and so that the flexure of said circuit board in a second direction results in a differential voltage of a second polarity.

20. A deflection sensor, comprising:

a flexible housing;

means, connected to one end of said housing, for connecting said housing to a support;

a strain gage, disposed within said housing and comprising:

a circuit board;

first, second, third and fourth strain gage elements disposed on a side of said circuit board and interconnected as a full resistance bridge, wherein said first, second, third and fourth elements each comprise conductors in a serpentine pattern printed directly onto said circuit board; and an amplifier circuit disposed on said circuit board and connected to said bridge, for amplifying a differential voltage from said bridge corresponding to a flexure of said circuit board; and wherein said first and second strain gage elements have more of their length than that of said third and fourth strain gage elements in a first common direction and are connected in said bridge to oppose one another;

and wherein said third and fourth elements have more of their length than that of said first and second strain gage elements in a second common direction perpendicular to said first common direction and are connected in said bridge to oppose one another.

* * * * *

UNITED STATES PATENT AND TRADEMARK OFFICE

CERTIFICATE OF CORRECTION

PATENT NO. : 5,392,027

DATED : February 21, 1995

INVENTOR(S) : Frank A. Brunot, James V. Motsinger and Michael P. Coppo

It is certified that error appears in the above-indentified patent and that said Letters Patent is hereby corrected as shown below:

Col. 5, ln. 45, between "board" and "should", insert --65--.

Col. 6, ln. 56, delete hyphen between "In" and "fence".

Col. 7, ln. 10, delete "$64_0$" and insert --$64_1$--.

Signed and Sealed this

Twenty-fourth Day of October, 1995

*Attest:*

Bruce Lehman

BRUCE LEHMAN

*Attesting Officer*

*Commissioner of Patents and Trademarks*